US008066119B2

(12) United States Patent
Doman

(10) Patent No.: US 8,066,119 B2
(45) Date of Patent: Nov. 29, 2011

(54) AUXILIARY GOLF CLUB HOLDER

(76) Inventor: Kenneth G. Doman, San Antonio, TX (US)

( * ) Notice: Subject to any disclaimer, the term of this patent is extended or adjusted under 35 U.S.C. 154(b) by 338 days.

(21) Appl. No.: 12/455,288

(22) Filed: Jun. 1, 2009

(65) Prior Publication Data

US 2010/0300907 A1 Dec. 2, 2010

(51) Int. Cl.
*A63B 55/00* (2006.01)
*A63B 55/06* (2006.01)
*A63B 55/04* (2006.01)

(52) U.S. Cl. ..... 206/315.2; 206/315.7; 206/315.6; 206/315.3; 294/143; 211/70.2

(58) Field of Classification Search ..... 206/315.2, 206/315.7, 315.3, 315.6; 294/143; 211/70.2
See application file for complete search history.

(56) References Cited

U.S. PATENT DOCUMENTS

| | | | | | |
|---|---|---|---|---|---|
| 2,502,627 | A * | 4/1950 | Martin | 206/315.6 |
| 2,987,109 | A * | 6/1961 | Sohmer | 294/143 |
| 3,415,572 | A * | 12/1968 | Zagwyn | 297/188.12 |
| 4,655,346 | A * | 4/1987 | Reinholz | 206/315.6 |
| 4,858,761 | A * | 8/1989 | Fumia | 206/315.3 |
| 5,425,452 | A * | 6/1995 | Shanks et al. | 206/315.7 |
| 5,984,395 | A * | 11/1999 | Halpen | 294/143 |
| 7,628,270 | B1 * | 12/2009 | Davis | 206/315.7 |
| 2004/0026279 | A1 * | 2/2004 | Miller | 206/315.2 |

* cited by examiner

*Primary Examiner* — Tri Mai

(57) ABSTRACT

Auxiliary golf club holder with three tubular members attached to each other by two side mounted pivot members. A top plate and bottom plate are hinged together at their front edge. The bottom plate is attached to the central tubular member. A rigid finger extends downwardly from the top plate. A locking handle is pivotably mounted to the bottom plate in a spring biased fashion. When the handle is rotated down, an extension tip at the top of the handle pushes the top plate up causing the finger to be pulled in so that it can frictionally engage the side wall of a standard golf bag and hold the auxiliary golf club holder onto the outside of the bag. The three tubes can be splayed out by the user to form a stable tripod configuration. A standard golf club can be safely and cleanly stored in each tubular member.

4 Claims, 8 Drawing Sheets

AUXILIARY GOLF CLUB HOLDER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of golfing accessories and more specifically to an auxiliary golf club holder.

The game of golf is a popular sport and is played by people from around the world. The game involves the user employing a golf club to hit a golf ball that is usually sitting on a grassy surface and to have the ball eventually drop into a small hole. To play the game properly, the golfer must use a variety of golf clubs depending on the distance to the hole and the conditions of the playing surface. The clubs are usually carried in a golf bag, which can be carried or rolled by the golfer from one hole to the next. Occasionally, there is the need for a golfer to take a few clubs to a location off the grass surface such as into a wooded area or sandy area, were bringing the entire, heavy golf bag full of clubs can be problematic.

To help the golfer carry two or three clubs to these less accessible areas, it would be beneficial to have an auxiliary club holder where the user can remove clubs from the larger golf bag and transport the needed clubs to a less accusable area. Attempts at such an auxiliary holder have been tried. Joseph Goulart, in his patent U.S. Pat. No. 4,371,022 discloses a holder that can carry a few clubs, however, when the user gets to the less accessible location, he or she must either lay the clubs down or use the grip handle portion of the clubs to form a tripod type stand. Unfortunately, this design can cause the grip portion of the heads to become soiled. Alternately, if the clubs are laid down on the ground, they become harder to retrieve. Charles Townsend, Jr's patent U.S. Pat. No. 6,640,970 shows an auxiliary holder that can be removed from a main golf bag. The major portion shaft of the club is protected by a plurality of tubular sleeves. However, once the user gets the clubs to the desired location, he or she must lay the entire assembly down on the ground because there is no way to have the auxiliary bag remain in a self supporting, standing position. Additionally, the inverted U shaped handle is adequate for carrying the device, but does not aid in helping firmly attach the auxiliary device to the larger, standard golf bag. Jogerni Laud's patent U.S. Pat. No. 7,077,274 discloses an apparatus for holding selected clubs. This device also causes the shafts of the clubs to be exposed and prone to soiling because the handle portions of the clubs touch the ground. Additionally, the user is required to deploy a single telescoping shaft and to insert the shaft tip into the ground to help hold the golf clubs in an upright position. This process can be time consuming and possibly non-workable if the tip of the telescoping shaft is not driven deep enough into the playing surface. Additionally, the device is not designed to firmly clamp onto the walls of the main bag and therefore can slid about when the main bag is being transported from on playing location to another.

BRIEF SUMMARY OF THE INVENTION

The primary object of the invention is to provide an auxiliary golf club holder that holds and protects up to three clubs and can be removably attached to the outside surface of a primary standard golf bag.

Another object of the invention is to provide an auxiliary golf club holder that has a built in locking mechanism for securing the auxiliary club holder to the top edge of a primary golf bag.

Another object of the invention is to provide an auxiliary golf club holder that holds clubs in a protected manner so that they are not subject to ground conditions that may soil the clubs.

A further object of the invention is to provide an auxiliary golf club holder that is self standing.

Yet another object of the invention is to provide an auxiliary golf club holder that can transition from the closed position to the open, self standing position and back to the closed position with the use of only one hand.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an auxiliary golf club holder comprising: a middle rigid tubular member, a right side rigid tube member, a left side rigid tube member, two side mounted pivot members, a rigid bag retaining finger, a rigid tube retaining top plate, a rigid bottom plate, a top plate to bottom plate hinge, a pivotable carry and locking handle, a compression spring, a spring guide post, a spring retainer member, said tubular members each having a lower end closure cap, said tubular members each capable of removably retaining a standard golf club shaft, said tubular members held together by side mounted pivot members so that when said right and left tubular members are pivoted, the three said tubular members form a stable tripod configuration, said tube retaining top plate attached to the front of said bottom plate by said top plate to bottom plate hinge, said bottom plate fixedly and perpendicularly attached to said middle tube member, said bag retaining finger fixedly and perpendicularly attached in a downward direction to said top plate, said spring guide post fixedly attached to the underside of said top plate and penetrating through an aperture in said bottom plate, said spring captured between the underside of said bottom plate and said spring retainer member located at the distal end of said spring guide post, said bottom plate including a pivot shaft that engages the pivot portion of said locking handle, said locking handle including an integral top extension tip that can slidably engage the underside of said top plate so that when said locking handle is swung down, said extension tip causes said top plate to be pushed up and said attached locking finger to be pulled in, and said pulling in of said finger causing said auxiliary golf club holder to be frictionally attached to the wall of a standard golf club bag.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
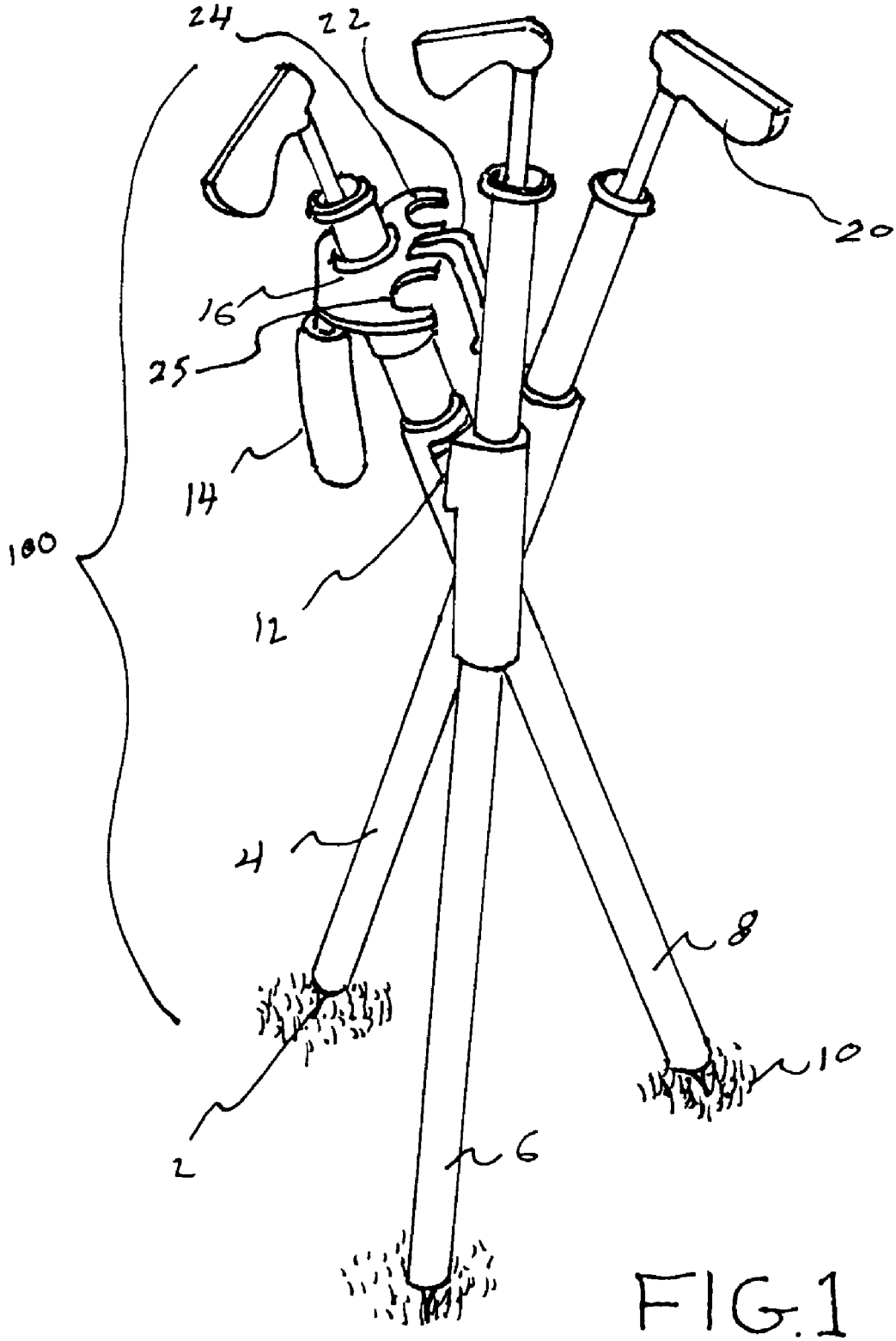
FIG. 1 is a perspective view of the invention shown removed from a main standard golf bag and set up in a self standing position.

Referring now to FIG. 1 we see a perspective view the auxiliary golf club holder of the present invention 100. The holder 100 is shown in its deployed position where rigid central tubular member 8, right tube member 6 and left tube member 4 form a tripod configuration allowing the invention to be self supporting. Downwardly disposed spikes 2 attached to the bottom of each tube 4, 6, 8 help the tubes to be anchored to the grassy 10 ground plane. The three tubes 4, 6, 8 are pivotally attached to each other at pivot points 12, 13, shown in FIG. 3. The bottom portions of each tube 4, 6, 8 are closed by a standard closure cap. The top portions of each tube 4, 6, 8 are open and sized to removably receive a standard golf club shaft. The hitting portion, or head, of each club 20 extend beyond the top edge of each tube 4, 6, 8. When the tubes 4, 6 are in the stored position, they rest in cut out areas 24, 25 in top plate 16. Locking and carry handle 14 is shown in the locked position. Locking finger 22 can be seen extending down perpendicularly from top plate 16 and will be described in more detail below.

Figure 2:
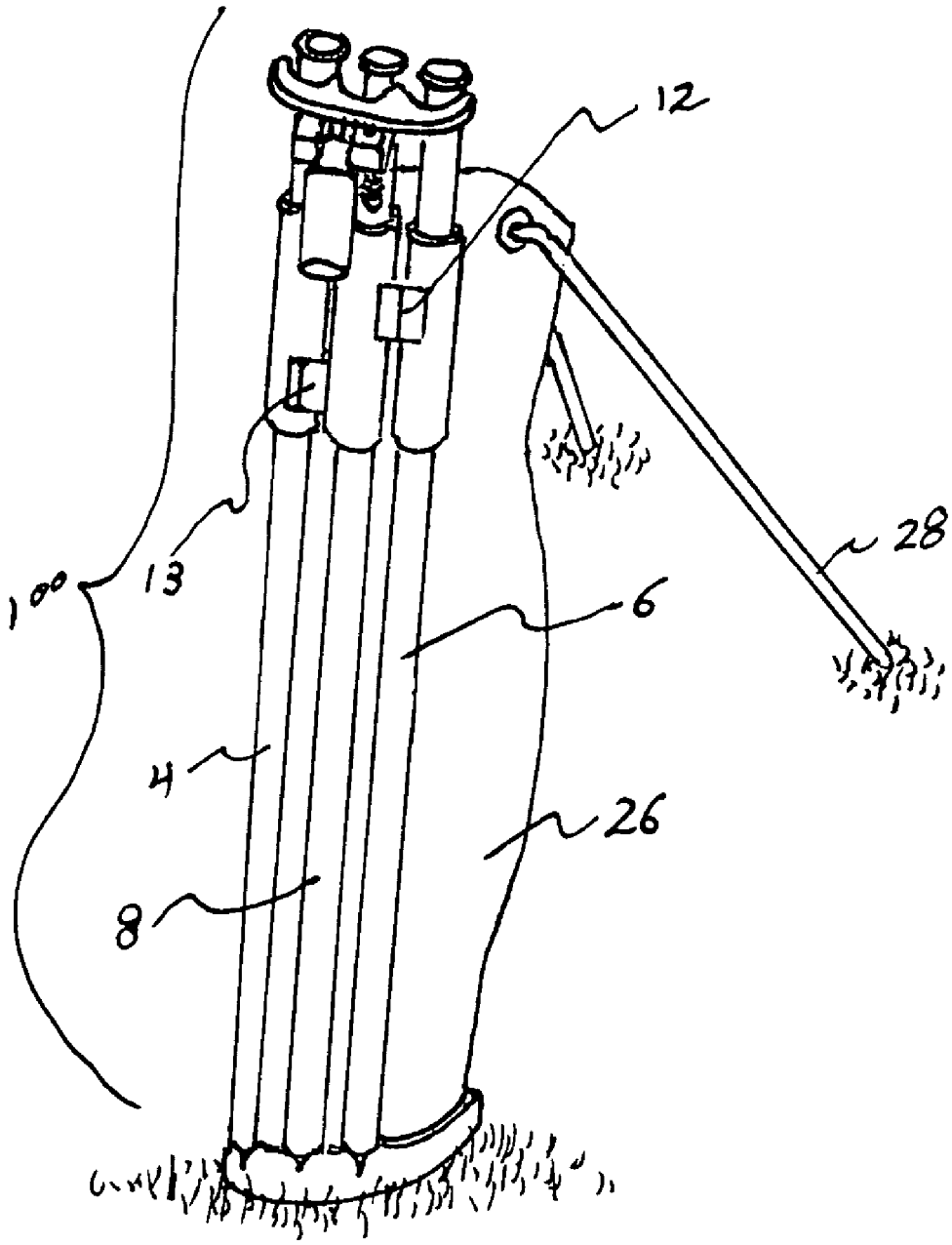
FIG. 2 is a perspective view of the invention shown attached to the outside of a main standard golf bag.

FIG. 2 shows a perspective view of the invention 100 in place on the outside wall of a standard golf bag 26. This outboard configuration does not interfere with the normal carrying of clubs within the main bag 26. Side pivot points 12, 13 can be seen. The location of these points allows the tubes 4, 6, 8 to form a self standing tripod shape when splayed outward as shown in FIG. 1. Standard swing out support poles 28 hold the main bag in a semi-upright position. The invention 100 is being frictionally held onto the side wall of the main bag 26 by a method described and shown below in FIGS. 3, 5 and 6.

Figure 3:
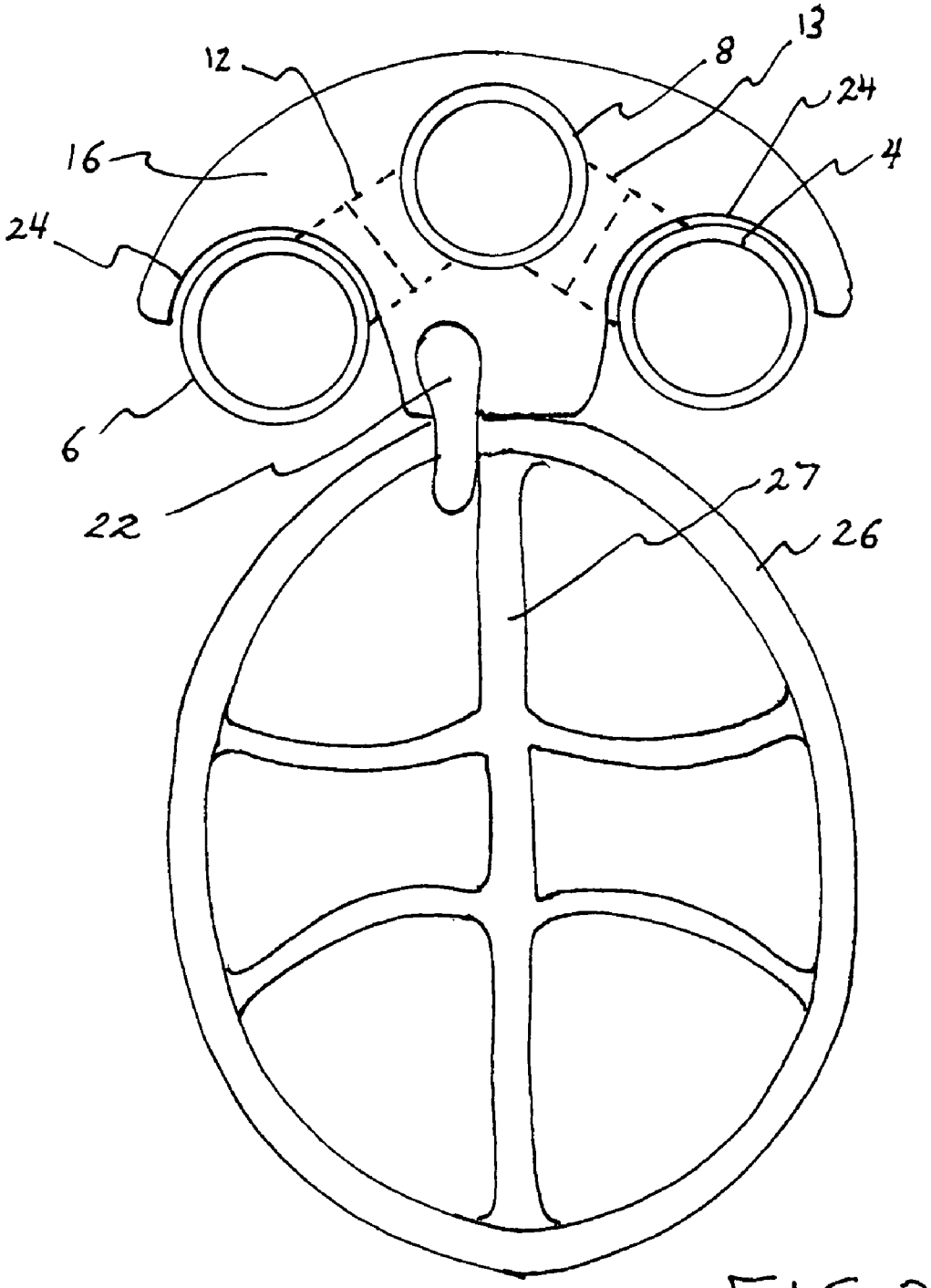
FIG. 3 is a top view of the invention while it is attached to a standard main golf bag.
Figure 8:
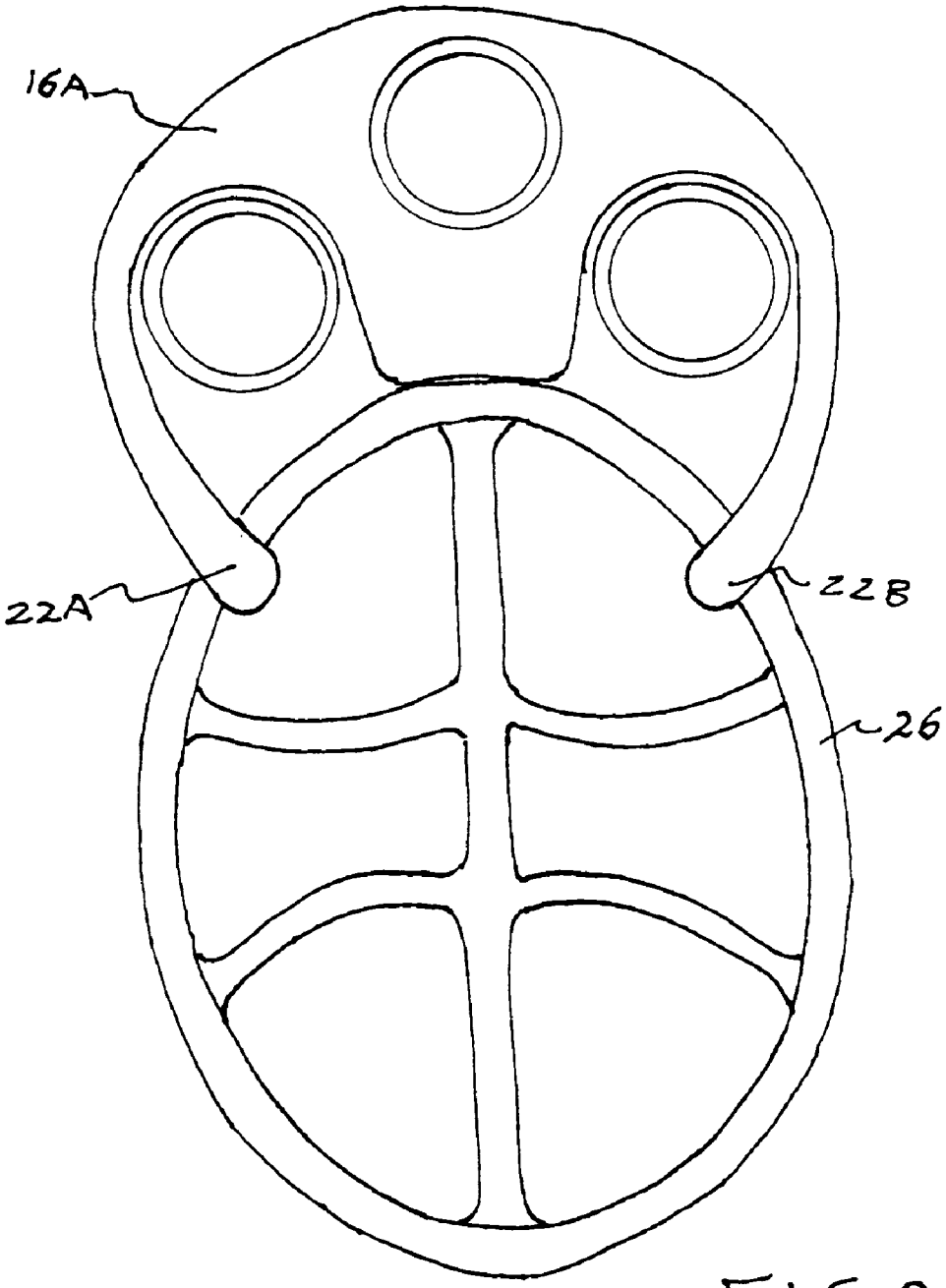
FIG. 8 is a top view of an alternate locking finger design where two locking fingers retain the invention to a standard golf bag rather than only one locking finger.

FIG. 3 is a top view showing top plate 16 with cutout portions 24, 25. Dash lines show the location of pivot members 12, 13. Rigid bag retaining finger 22 can be seen as it grasps the side wall of golf bag 26. It should be noted that for a more secure grasp, a second retaining finger located on the opposite side of divider panel 27 can be employed to hold the invention 100 onto the outside wall of bag 26. Alternately, the retaining fingers can be located on left and right extensions to top plate 16 as shown in FIG. 8 where top plate 16A includes extension fingers 22A, 22B that attach to bag wall 26 in two places thereby making the attachment more sturdy.

Figure 4:
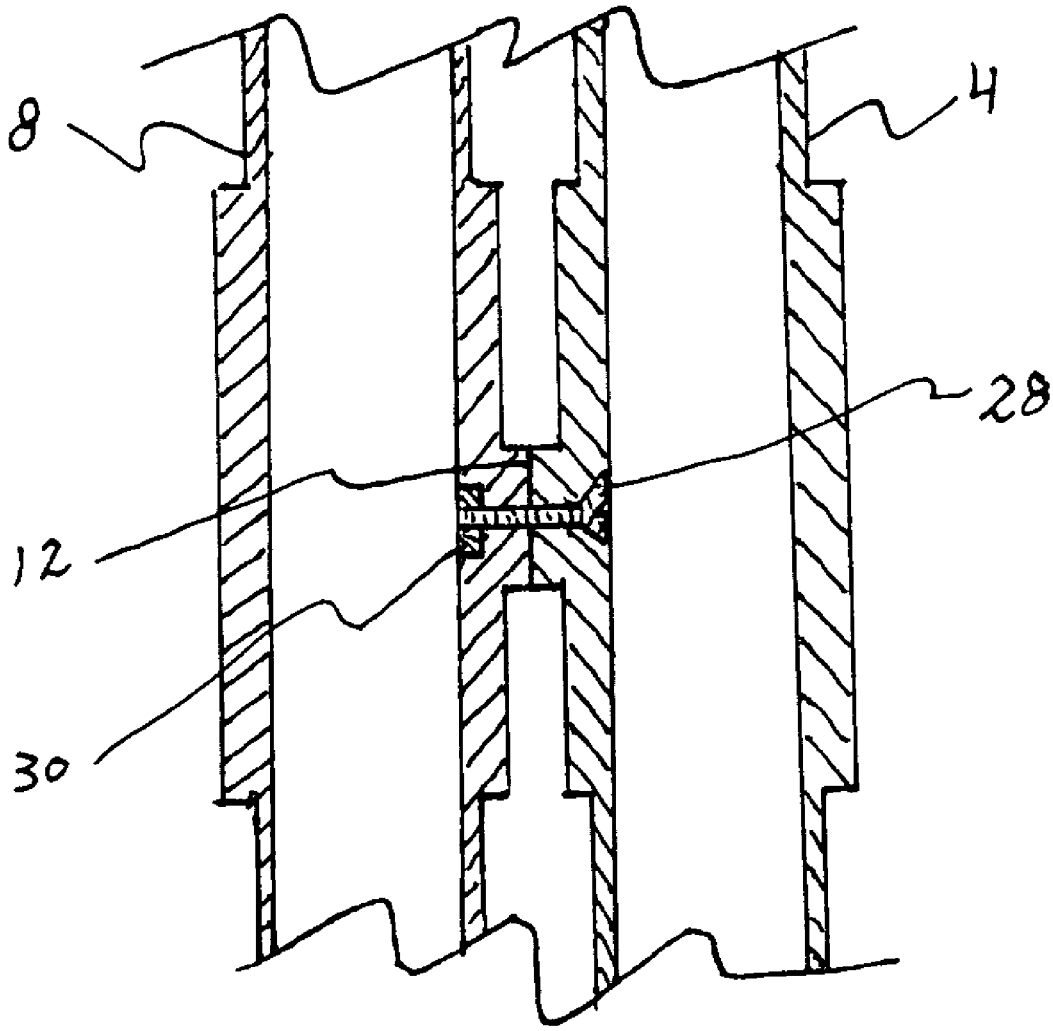
FIG. 4 is a partial side section view showing the pivot attachment means the tubular members together.

FIG. 4 shows a partial side section view of two of the rigid tubes 4, 8 and their mating pivot member 12. A counter sink screw 28 is retained by a lock nut 30 or other standard means of attachment. The attachment means is such that it does not interfere with the insertion or removal of a golf club shaft.

Figure 5:
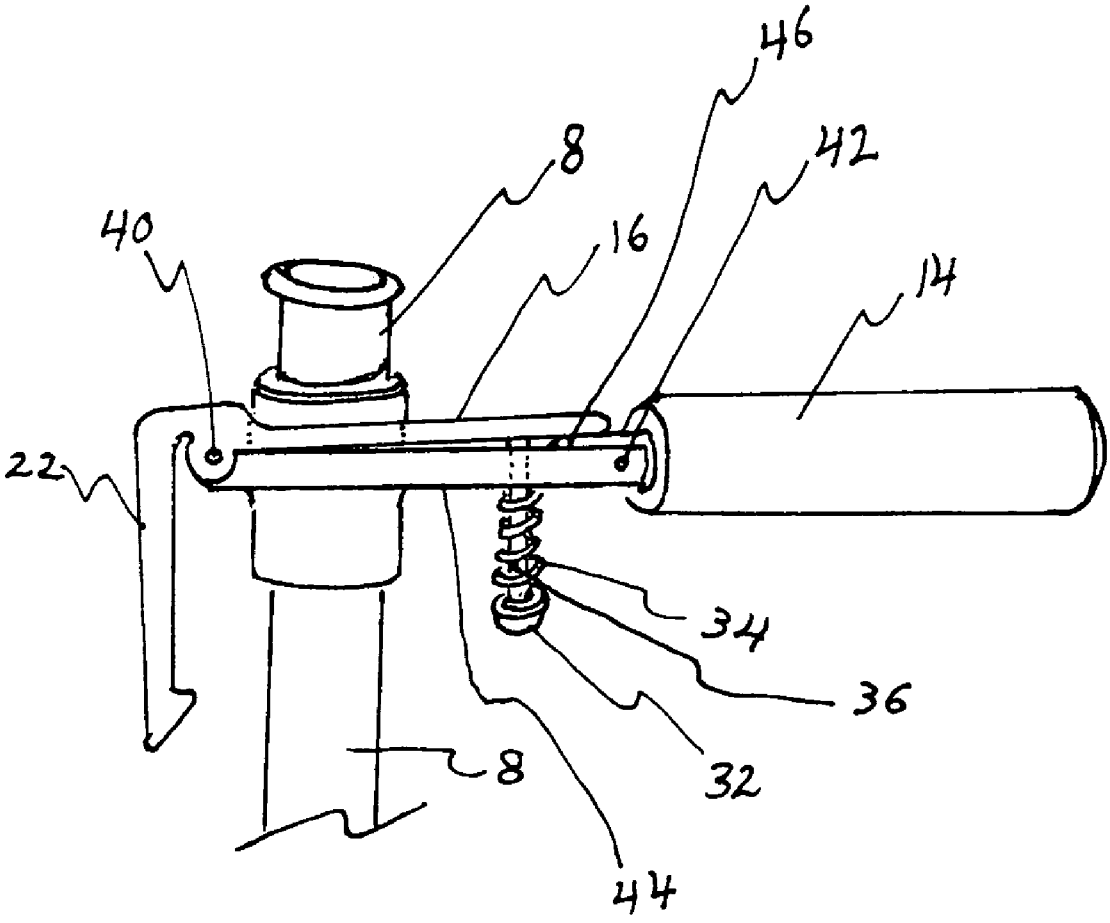
FIG. 5 is a partial side view of the bag attachment mechanism in the unlocked position.
Figure 6:
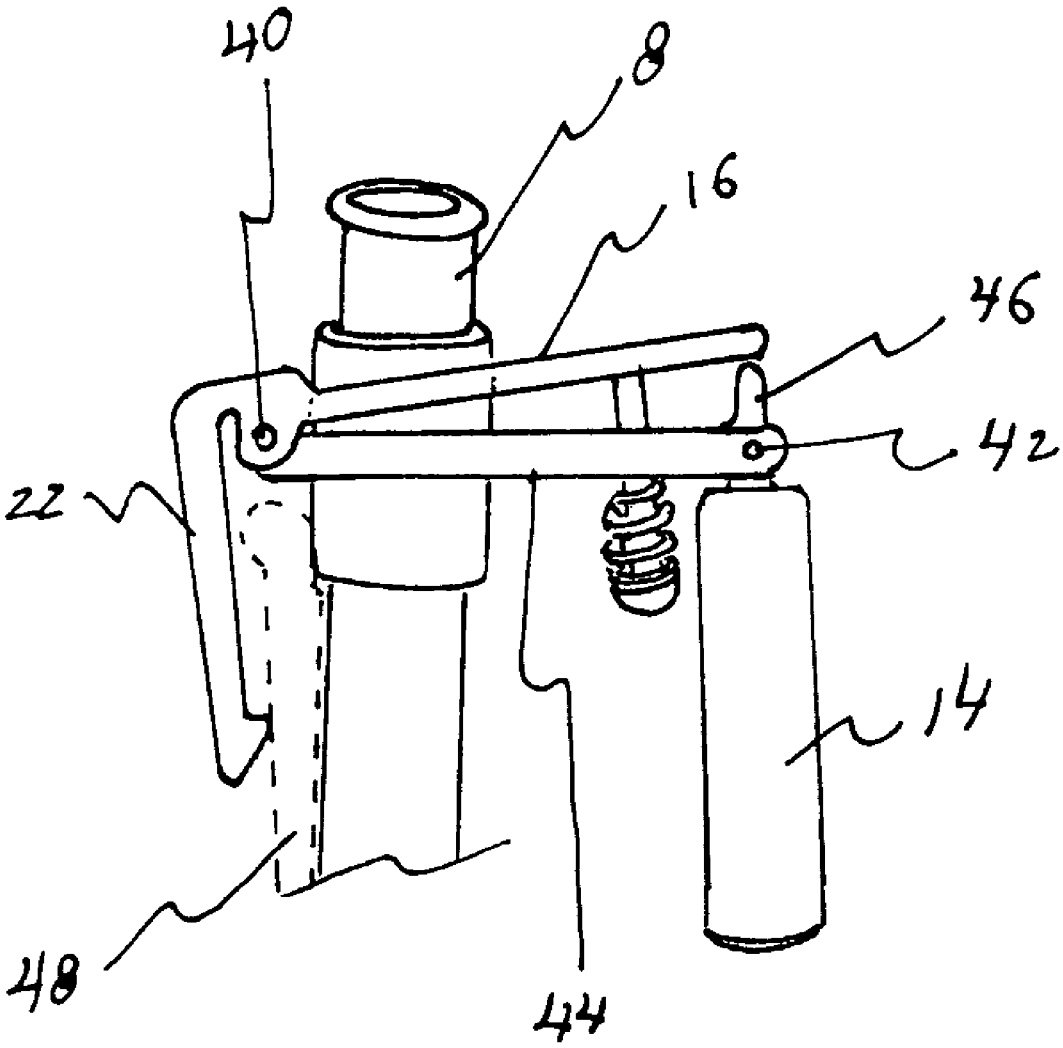
FIG. 6 is a partial side view of the bag attachment mechanism in the locked position.

FIG. 5 shows a partial perspective view of the bag retaining mechanism. Carry and lock handle 14 is in the parallel, unlocked position. Rigid bottom plate 44 is fixedly attached to central tube 8. a top plate to bottom plate hinge 40 attaches the two plates 16, 42 at their front edge. A spring guide post 36 is fixedly attached to the underside of top plate 16. The guide post 34 extends downward through an aperture in bottom plate 44 as shown by dotted lines. A compression spring 34 is retained between the underside of lower plate 46 and spring retainer 32. The carry, lock handle 14 can rotate downward via pivot pin 42. A top extension tip 46 is fixedly attached to the top of handle 14. When a person rotates handle 14 in a downward fashion, The extension tip 46 lifts top plate 16 and causes locking finger 22 to pull inward and frictionally attach to the side wall of a standard golf bag as shown by dotted line 48 shown in FIG. 6. A torsion spring located in the hinge area 40 can be substituted for compression spring 34.

Figure 7:
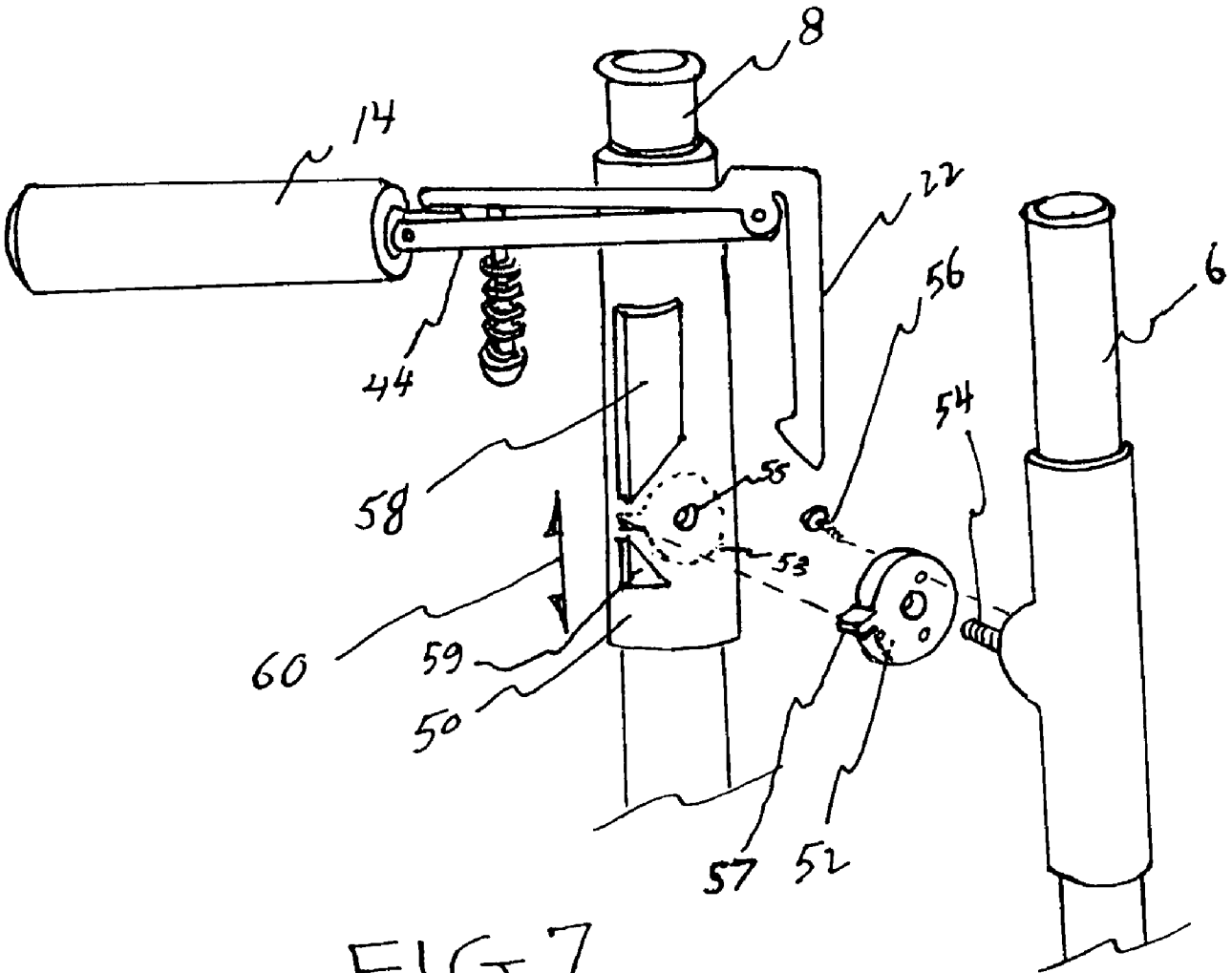
FIG. 7 is a partial side exploded view of a mechanism that lets the user deploy the invention with one hand.

FIG. 7 shows a partial exploded view of an alternate embodiment of the invention. A cam 52 with and extension tab 57 is fixedly mounted to the pivot area of tube 6 by screws 56 or other standard means and resides just under upper ramp 58 and just above lower ramp as shown by dotted line 53. The bolt post 54 enters aperture 55 and acts as the pivot shaft and is held by a nut or other standard fastener, not shown, on the inside wall of slidable tube 50. Tube 50 is fixedly mounted to bottom plate 44. In this alternate embodiment, central tube 8 is longer, at the bottom, than tube 4 or 6. When the user grasps handle 14 and pushes down slide tube 50, as indicated by direction arrow 60, while central tube 8 is firmly planted in the ground, the ramp member 58 engages cam tab member 57 and in so doing, forces tubular member 6 to be automatically splayed out into the tripod position. When the user is ready to lift the invention, in preparation for its return a standard golf bag, cam tip 57 engages lower ramp 59 causing the tube 6 to return to its stored position where it is parallel to tube 8. A mirror image of components 52, 54, 58, 59 are incorporated on the opposite side of central tube 8 to cause tubular member 4 to also splay outward when pushing down on handle 14 and attached plate 44 and attached downwardly sliding tube 50. And also return to the stored position when lifting up on handle 14 and attached plate 44 and attached upwardly sliding tube 50. Because the tubes 4, 6 are shorter than central tube 8, the splaying action is not impeded by either of the two pivoting tubes 4, 6. In this alternate embodiment, the splaying action, to form a tripod, can be accomplished with only one hand which is grasping handle 14. Additionally, the action to return the splayed tubes 4, 6 to the stored position can also be accomplished with one hand.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Auxiliary golf club holder comprising:
a middle rigid tubular member;
a right side rigid tube member;
a left side rigid tube member;
two side mounted pivot members;
a rigid bag retaining finger;
a rigid tube retaining top plate;
a rigid bottom plate;
a top plate to bottom plate hinge;
a pivotable carry and locking handle;
a compression spring;
a spring guide post;
a spring retainer member;
said tubular members each having a lower end closure cap;
said tubular members each capable of removably retaining a standard golf club shaft;
said tubular members held together by side mounted pivot members so that when said right and left tubular members are pivoted, the three said tubular members form a stable tripod configuration;
said tube retaining top plate attached to the front of said bottom plate by said top plate to bottom plate hinge;
said bottom plate fixedly and perpendicularly attached to said middle tube member;
said bag retaining finger fixedly and perpendicularly attached in a downward direction to said top plate;
said spring guide fixedly attached to the underside of said top plate and penetrating through an aperture in said bottom plate;
said spring captured between the underside of said bottom plate and said spring retainer member located at the distal end of said spring guide post;
said bottom plate including a pivot shaft that engages the pivot portion of said locking handle;
said locking handle including an integral top extension tip that can slidably engage the underside of said top plate so that when said locking handle is swung down, said extension tip causes said top plate to be pushed up and said attached locking finger to be pulled in; and
said pulling in of said finger causing said auxiliary golf club holder to be frictionally attached to a standard golf club bag.

2. Auxiliary golf club holder as claimed in claim 1 wherein said end caps each include a downwardly disposed spike for anchoring said tubes into a grassy ground surface.

3. Auxiliary golf dub holder as claimed in claim 1 wherein an alternate embodiment includes a slidable outer tube positioned around said middle tubular member where said outer tube is fixedly attached to said top and bottom plate assembly and where said outer tube includes an integral pair of side mounted ramps that can slidably engage cam members located at the pivot points of right and left side tubular members so that when a person holds onto said carry handle and pushes down on said central tubular member, said right and left tubular members automatically are forced into the tripod position.

4. Auxiliary golf club holder as claimed in claim 1 wherein an alternate embodiment includes a pair of said bag retaining fingers;
one said finger extending down from the left side of said top plate, and one said finger extending down from the right side of said top plate.

* * * * *